US005964087A

United States Patent [19]

Tort-Oropeza

[11] Patent Number: 5,964,087

[45] Date of Patent: Oct. 12, 1999

[54] EXTERNAL COMBUSTION ENGINE

[76] Inventor: Alejandro Tort-Oropeza, Peñas 280, Jardines Del Pedregal De San Angel Delegacion Alvaro Obregon, C.P. 01900, Mexico

[21] Appl. No.: 08/807,199

[22] Filed: Feb. 27, 1997

Related U.S. Application Data

[63] Continuation-in-part of application No. 08/512,148, Aug. 7, 1995, abandoned.

[30] Foreign Application Priority Data

Aug. 8, 1994 [MX] Mexico ..... 9406028

[51] Int. Cl.[6] ..... F02G 3/02

[52] U.S. Cl. ..... 60/39.63; 60/39.55

[58] Field of Search ..... 60/39.23, 39.6, 60/39.63, 39.55

[56] References Cited

U.S. PATENT DOCUMENTS

| | | | |
|---|---|---|---|
| 1,013,907 | 1/1912 | Taylor | 60/39.63 |
| 1,302,582 | 5/1919 | Norman | 60/39.63 |
| 1,510,988 | 10/1924 | La Fon | 60/39.63 |
| 2,140,085 | 12/1938 | Maina | 60/39.63 |
| 2,404,395 | 7/1946 | Milliken | 60/39.23 |
| 3,708,976 | 1/1973 | Berlyn | 60/39.63 |
| 3,839,858 | 10/1974 | Avermaete | 60/39.63 |
| 3,927,520 | 12/1975 | Arvin | 60/39.23 |
| 4,255,927 | 3/1981 | Johnson | 60/39.63 |

FOREIGN PATENT DOCUMENTS 52-3906 1/1977 Japan .

*Primary Examiner*—Michael Koczo
*Attorney, Agent, or Firm*—Ladas & Parry

[57] ABSTRACT

This invention refers to an engine that has the advantage over the internal combustion engines currently in use, that it substantially reduces the emission of contaminants of carbon monoxide, unburned fuel, nitrogen oxides, lead compounds and solid particles, with increased efficiency. This is accomplished by performing the combustion externally to the engine cylinders, in a combustion chamber especially designed to obtain a complete combustion, while maintaining its temperature at a value sufficiently low to reduce the formation of nitrogen oxides by means of an adequate distribution of the combustion air, and by the injection of the water that cools the jackets of the engine into the combustion chamber.

16 Claims, 5 Drawing Sheets

EXTERNAL COMBUSTION ENGINE

This is a Continuation-in-Part of U.S. patent application Ser. No. 08/512,148 filed Aug. 7, 1995 (abandoned).

BACKGROUND

Many efforts and a great deal of work have been made and done to reduce the contaminants emitted by the Otto and Diesel internal combustion engines in current use, such as carbon monoxide, unburned fuel, nitrogen oxides, lead compounds and solid particles; and some improvements have been obtained, but those engines continue to emit contaminants in intolerable quantities. The only practical solution achieved so far is to eliminate the contaminants by means of catalytic converters after they have already been formed, with the inconveniences of efficiency loss, generation of unusable heat and additional cost. Besides, the Diesel engines emit health harming solid particles that the converters cannot eliminate.

The main, problem of the current internal combustion engines is precisely that the combustion occurs in the cylinder "dead space"; this is the volume of the cylinder not swept by the piston. This space is a wafer, a cylinder of a very, small height and required to achieve the necessary compression. Its geometry is totally inadequate as a combustion chamber; within the volume of the dead space, the combustion gases encounter very hot zones where nitrogen oxides are formed and cold zones where the combustion is chilled. In spite of the improvements achieved, its inherent geometry makes it impossible to obtain a complete solution.

In the engine described in this invention, a complete combustion is accomplished with reduced production of contaminants, and with increased efficiency.

Several engines with combustion chambers or combustors external to the cylinders have been proposed. A well designed external combustor by itself can improve the combustion, but it can not reduce sufficiently the formation of nitrogen oxides. The applicant filed an application before the U.S. Patent Office about this principle on Mar. 2, 1971, Ser. No. 05/120,166, same that was not pursued because it was realized that it would not solve some of the major problems.

Other prior art documents related with the field of the invention are as follows:

U.S. Pat. No. 2,140,085 to Maina, dated Dec. 13, 1938 discloses an engine in which the water is forced through a coiled thread in order to heat and vaporize the water, inject it into the combustor or pressure generator, mix it with the combustion gases and expand the mixture in the power cylinder. Here, the heat transmitted to the water is taken from the energy of the combustion gases reducing their capacity to generate mechanical energy. As only a fraction of the heat transmitted can be recuperated as mechanical energy when the additional steam produced by the injected water is expanded in the power cylinder, the efficiency of the cycle is reduced which is the opposite to the intention of the applicant invention.

In the applicant's invention the purpose of the combustor jacket is not to absorb heat because this would reduce the efficiency of the cycle even if the steam generated is injected in the combustor. The purpose is to maintain the inner wall of the combustor within a metal tolerable temperature range. The efficiency of the cycle is increased not because the heat transmitted to the jacket of the combustor is recuperated, but because the heat transmitted to the jackets of the power mechanism and the compressor is recuperated and a fraction of that heat is converted into mechanical energy in the power mechanism instead of being dissipated in a radiator.

Moreover, in the applicant's invention, an important feature is that the water injected is the same that cools all the jackets of the engine, and that by doing so the emission of contaminants is reduced and the efficiency of the cycle is increased. The invention of Maina includes besides the thread in the pressure generator, cooling jackets in the power cylinder, in the compressor and even around the thread in the pressure generator, but there is not any mention that could suggest that the water injected is the same that cools the jackets.

The invention of Maina does not include any means in the combustor to improve the combustion; and the disclosure does not make any mention of having the intention to reduce the formation of contaminants.

U.S. Pat. No. 2,404,395 to Milliken dated Jul. 23, 1946, discloses a low pressure compressor, a high pressure compressor, an external combustor, a high pressure engine, a low pressure engine, and a primary and a secondary heat exchanger. The air compressed by the low pressure compressor is the fluid that cools the jackets of the high pressure compressor and the high pressure engine. There is no water cooling, there is no water injection and there is no intention of reducing the formation of contaminants.

In the present invention the cooling medium is water and the cooling water is injected into the combustion gas stream to reduce the formation of contaminants and to increase the efficiency.

The invention of Milliken does not include any means in the combustor to improve the combustion.

Japanese Patent No. 52-3906 to Tanegashima, discloses an engine, which includes a compressor, an output generator, and a combustor external to the engine cylinder with several air inlets. It does not include any means to inject the water that cools the jackets of the engine into the combustor. The figures do not even show water jackets.

U.S. Pat. No. 4,255,927 to Johnson, dated Mar. 17, 1981, refers to a combustion system for gas turbines that includes a combustor with several excess air entrances in the reaction zone to produce fuel lean or fuel rich mixtures as required to lower the combustion temperature and reduce the formation of nitrogen oxides. Besides, it maintains an efficient combustion across a wide range of turbine loads by means of a mechanism that shifts the air flow as required between the reaction zone and the dilution zone. Intended as it is for turbine applications it does not include water cooled jackets, nor water injection.

U.S. Pat. No. 3,927,520 to Arvin, dated Dec. 23, 1975 refers to a turbine combustion apparatus adapted to reduce emissions for automotive applications. It includes a combustor with several air control entrances in a prechamber and in the reaction zone. Intended as it is for turbine application it does not include water cooled jackets, and no water injection.

U.S. Pat. No. 1,013,907 to Taylor, dated Jan. 9, 1912 discloses an engine which includes several power cylinders, an air pump and a combustor with water cooled jacket. The water that cools the jacket is injected in the combustor to turn it into steam so as to cool the products of combustion and thereby lower the temperature of the fluid supplied to the engine. The intention is that the temperature of the mix of the combustion products and steam have a temperature tolerable to the metal parts of the engine. The power cylinders have no water cooled jackets; neither does the air pump.

This invention does not include any means in the combustor to improve the combustion, and the intention of the inventor never was to reduce the formation of contaminants.

U.S. Pat. No. 1,302,582 to C. A. Norman, dated May 6, 1919 discloses one compressor cylinder, one combustion chamber and three expansion cylinders. The interior of the combustion chamber is lined with a refractory material. The cylinders of the compressor and the expansion cylinders have jackets. There is nothing that could suggest that the water injected is the same that cools the jackets.

The invention of Norman does not include any means in the combustor to improve the combustion, nor suggest the intention of reducing the formation of contaminants.

U.S Pat. No. 1,510,688 of A. La Fon, dated Oct. 7, 1924 discloses an engine which includes a compressor, an external combustor with a venturi exit and a work cylinder. The water that cools the jackets of the compressor and the combustor is injected in the venturi throat. In this invention the combustion products, will have their temperature reduced by the heat taken by the water which is converted into steam, and hence the engine, and its lubricants, will not be burned by excessively hot gases.

As the intention of La Fon is to reduce the temperature of the mix of the combustion gases and the steam produced by the water injected to a temperature tolerable by the metal parts of the engine, the work cylinder has no water cooled jackets. Moreover, the invention of La Fon does not include any means in the combustor to improve the combustion; and there is nothing in the disclosure that could suggest the intention to reduce the formation of contaminants.

U.S. Pat. No. 3,708,976 to Martin John Berlyn dated Jan. 9, 1973, refers to a vapor generator. It is an apparatus analogous to a boiler. It does not refer to an engine. It includes a compressor, an external combustor and an auxiliary expansion motor that drives the compressor.

Since the intention is to produce a fluid of temperature similar to that of a boiler, neither the compressor, the combustor nor the motor have jackets. Moreover, the invention of Berlyn does not include any means in the combustor to improve the combustion; and it is not intended to reduce the formation of contaminants.

U.S. Pat. No. 3,839,858 to VAN AVERMAETE dated Oct. 9, 1973, refers to a combustion reciprocating machine that provides an efficient and fast operating starting device and a reasonable output, no matter what the working conditions may be. It includes a two stage compressor with jackets, an external combustion chamber with jackets and a power cylinder with jackets. It does not make any mention to the water cooling of the jackets, nor to water being injected in the combustor, nor to an intention of reducing the formation of contaminants, or increasing the efficiency. The invention of Van Avermaete does not include any means in the combustor to improve the combustion; his description does not make any mention of having the intention to reduce the formation of contaminants.

SUMMARY OF THE INVENTION

In contrast with all the documents of the prior art, cited herein, the present invention refers to an engine that includes water cooled jackets in all the major components of the engine. The water that circulates through and cools the jackets of the system is injected in the combustor to reduce the formation of nitrogen oxides and to increase the efficiency of the engine.

The principle of this invention is to perform the combustion in a combustion chamber or combustor external to the engine cylinders, where the combustion can be controlled so it is complete with a minimum emission of CO and unburned fuel. The combustion performed in a combustor does not require antidetonants and therefore no lead compounds are emitted. Besides, the combustion temperature is limited to a value sufficiently low to minimize the formation of nitrogen oxides by means of injecting water preferably demineralized or distilled in the combustor. The water injected is the same that cools the jackets of the different components of the engine. The steam generated by the water mixes with the combustion gases and expands with them in the power mechanism. In this fashion the double objective of reducing the formation of contaminants and increasing the efficiency is achieved.

This external combustion engine is comprised principally by a compressor, a power mechanism, a combustion chamber or combustor and a water circulation system that forces the water through jackets of the engine and injects it into the combustor.

BRIEF DESCRIPTION OF THE DRAWINGS

The details that characterize this invention are shown in the attached drawings, in which the principal components are identified with reference numbers that correspond to the following description.

To simplify this description a reference number identifying any part is the same in all the figures.

DETAILED DESCRIPTION OF THE INVENTION.

Figure 1:
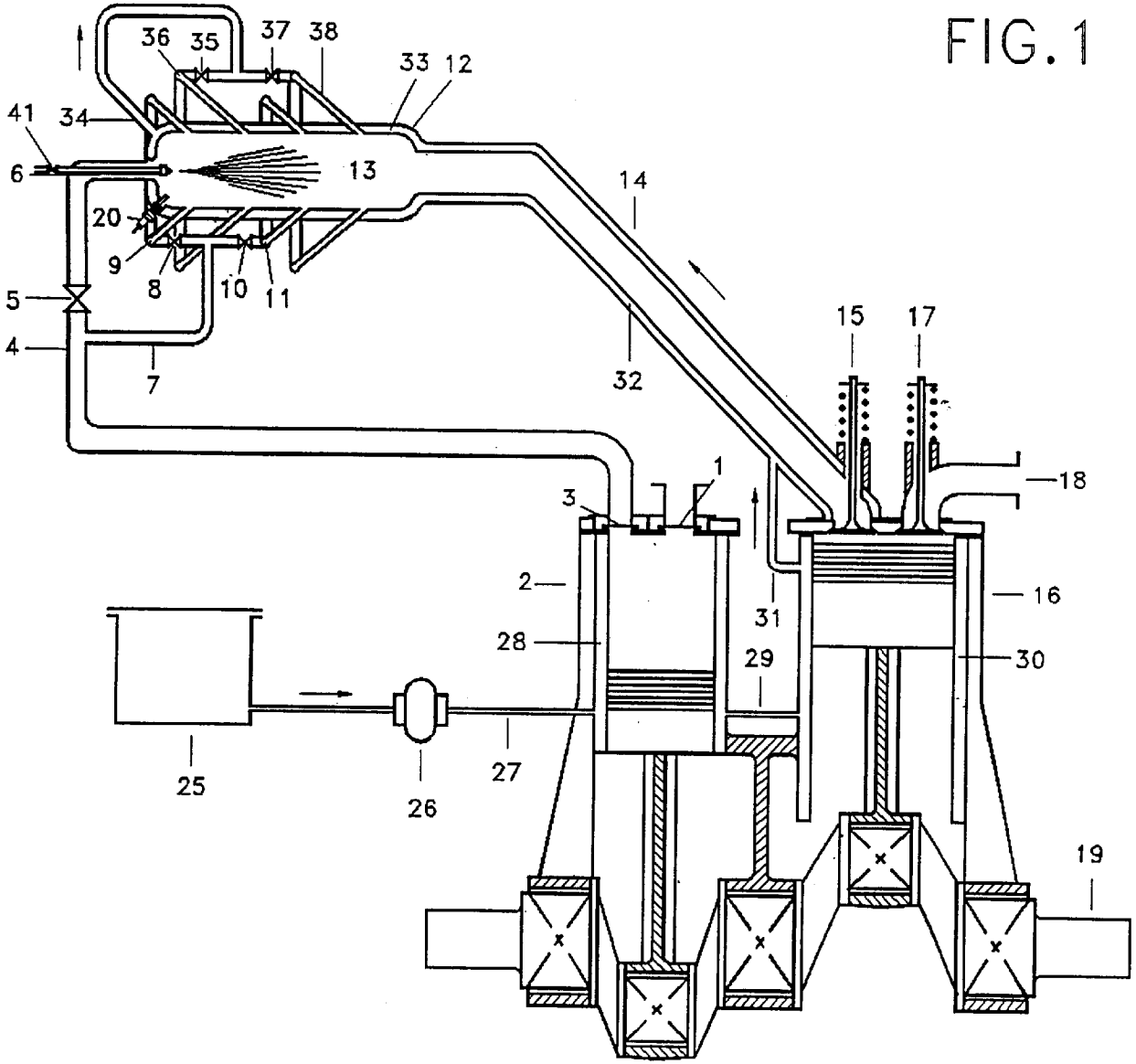
FIG. 1 shows a sectional view of the engine and how it operates.

FIG. 1 shows an engine comprised by a compressor 2 a combustor 12 a power mechanism 16 which converts the thermal energy to mechanical energy. A water tank 25, and a water cooling pump 26. Other devices normally encountered in an engine such as the starter motor, the fuel pump, the fuel tank, the cam shaft that operates the engine valves, etc., are not shown because their illustration is not necessary for this description.

The compressor 2 of FIG. 1 is of the reciprocating single stage cylinder and piston type, with disk type admission and discharge valves 1 and 3 and with at least one water cooled jacket 28. It is operated by the crankshaft 19 of the power mechanism 16. The compressor is integrated into the same frame as the power mechanism, but in other embodiments (not shown) it can have an independent frame, several cylinders, poppet type valves, several stages with intercoolers located between the stages, be air cooled by external fins, be of the rotary type, and be driven by the power mechanism by means of coupling, gears, belts, sprockets, transmission chains, variable speed drive, or by electric drive.

The combustor 12 is a pressure vessel designed to withstand the operating pressure of the engine. It is equipped with at least one water cooled jacket and several controlled entrances for air, fuel and water intended to optimize the combustion and to reduce the formation of contaminants.

The power mechanism 16 shown in FIG. 1 is of the reciprocating type. It has only one cylinder with one admission valve 15 and one exhaust valve 17 operated conventionally by a cam shaft and rocker arms not illustrated in this figure. It is shown in this manner to simplify the description, but it can have several cylinders arranged in line or in V, or be of the rotary type. The power mechanism is equipped with at least one water cooled jacket.

The operation is as follows: The compressor 2 admits atmospheric air through valve 1, compresses it, and introduces it through valve 3, air duct 4, valve 5 and opening 6 into the combustor 12 where it mixes with the fuel injected by a fuel nozzle 41. The spark plug 20 initiates the combustion. Part of the air can be diverted through duct 7 and be injected into the combustor through valve 8 to the second entrances 9 and through valve 10 to the third entrances 11.

The pump 26 sucks the cooling water from the tank 25 and forces the water through conduit 27, the jacket 28 of the compressor, the conduit 29, the jacket 30 of the power mechanism, the conduit 31, the jacket 32 of the duct 14 interconnecting the combustor and the power mechanism, and the jacket 33 of the combustor 12. The water emerges from the combustor jacket through the opening 34 and is injected into the combustor plenum 13 through valves 35 and 37 and entrances 36 and 38. The arrows show the path of the water from the water tank to the combustor.

As the cooling water advances, it absorbs the heat transmitted through the internal walls of the jackets of the engine, its temperature increases and it could become vaporized. The water is then injected into the combustor, mixes with the combustion gases, becomes superheated and as it expands with the combustion gases in the power mechanism increases the total conversion energy of the combustion gases and rises the efficiency of the cycle. A substantial part of the heat transmitted through the internal walls of the engine is recuperated instead of being dissipated in a radiator.

After expansion through the power mechanism 16 the exhaust valve 17 opens and the gases are expelled through exhaust port 18.

The volumes of the cylinders of the compressor and the power mechanism are proportionate so the gases produced by the combustion plus the steam generated by the injected water can be accepted by the cylinder of the power mechanism.

The nitrogen oxides of the expelled gases have two origins. First, the fuel may have nitrogen in its composition. This nitrogen combines easily with the oxygen during the combustion. For this reason the modern industrial burners supply the combustion air at several stages of the combustion zone so that no particular region has to much excess of air. This can be done in a combustor but not in the dead space of a cylinder.

Figure 2:
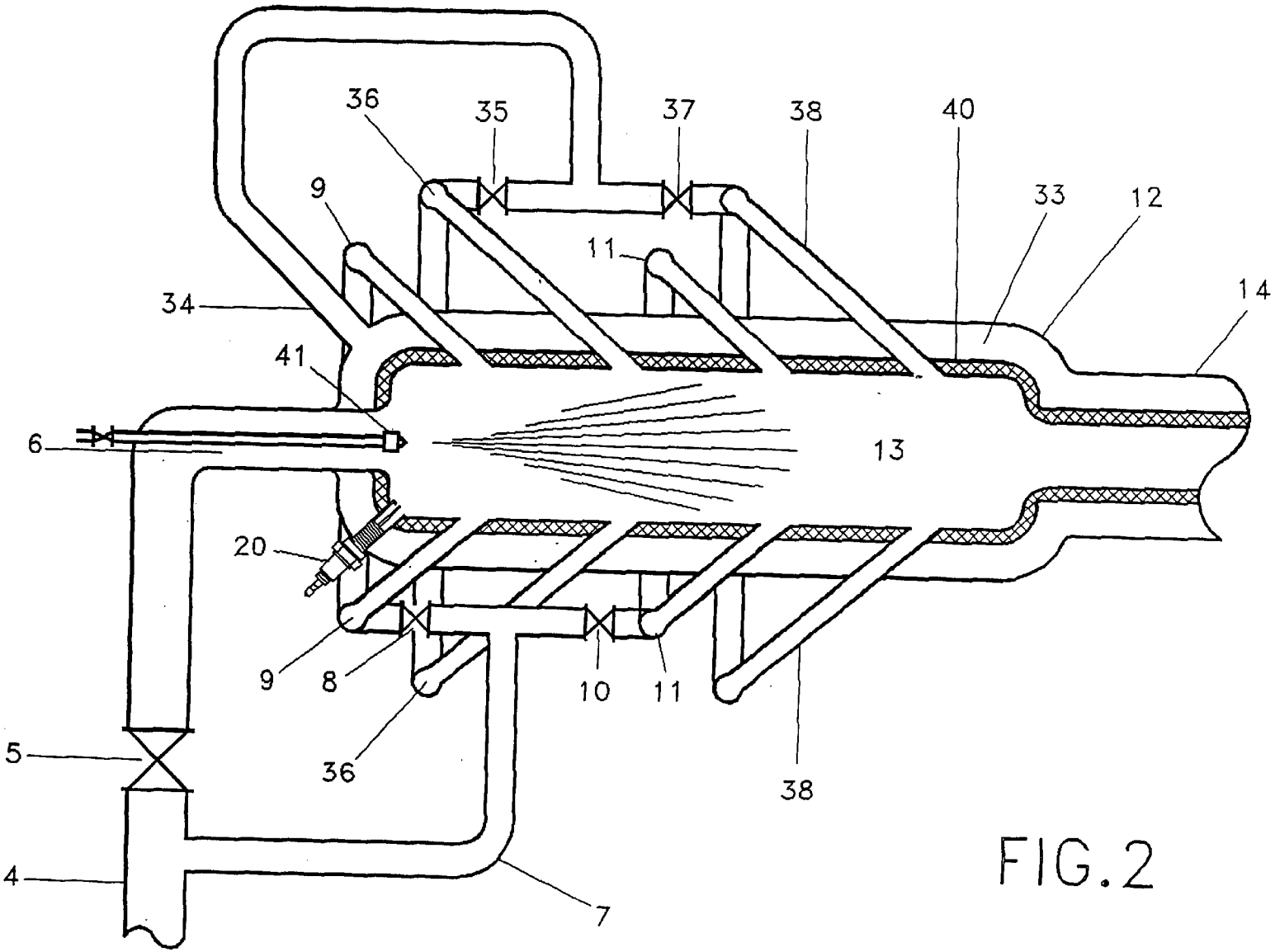
FIG. 2 shows an enlarged view of the combustor shown in FIG. 1.

FIG. 2 illustrates this condition. In order to reduce the formation of nitrogen oxides the first part of the combustion zone is maintained with deficiency of oxygen by diverting part of the combustion air to the second entrances 9 of the combustor and to the third entrances 11. The flow to these entrances can be controlled by valves 8 and 10 in order to obtain the most efficient combustion.

The second origin or source of the nitrogen oxides is the result of the combination of the nitrogen in the air with the oxygen. This chemical reaction depends of various factors, of which the temperature of the gases in the combustor and in the duct that connects it with the power mechanism is the most important. If this temperature is maintained at a value sufficiently low, the generation and emission of these nitrogen oxides is further reduced. The numerical value of this temperature depends on the other factors intervening in the reaction, but still can be sufficiently high to guarantee an efficient and complete combustion. To reduce the combustion temperature to the desired value, the water or steam that emerges from the jacket of the combustor through port 34 is injected into the combustor plenum 13 through entrances 36 and 38. In order to obtain the maximum reduction of nitrogen oxides formation with a minimum of combustion disturbance the flow to these entrances is regulated by valves 35 and 37.

Figure 3:
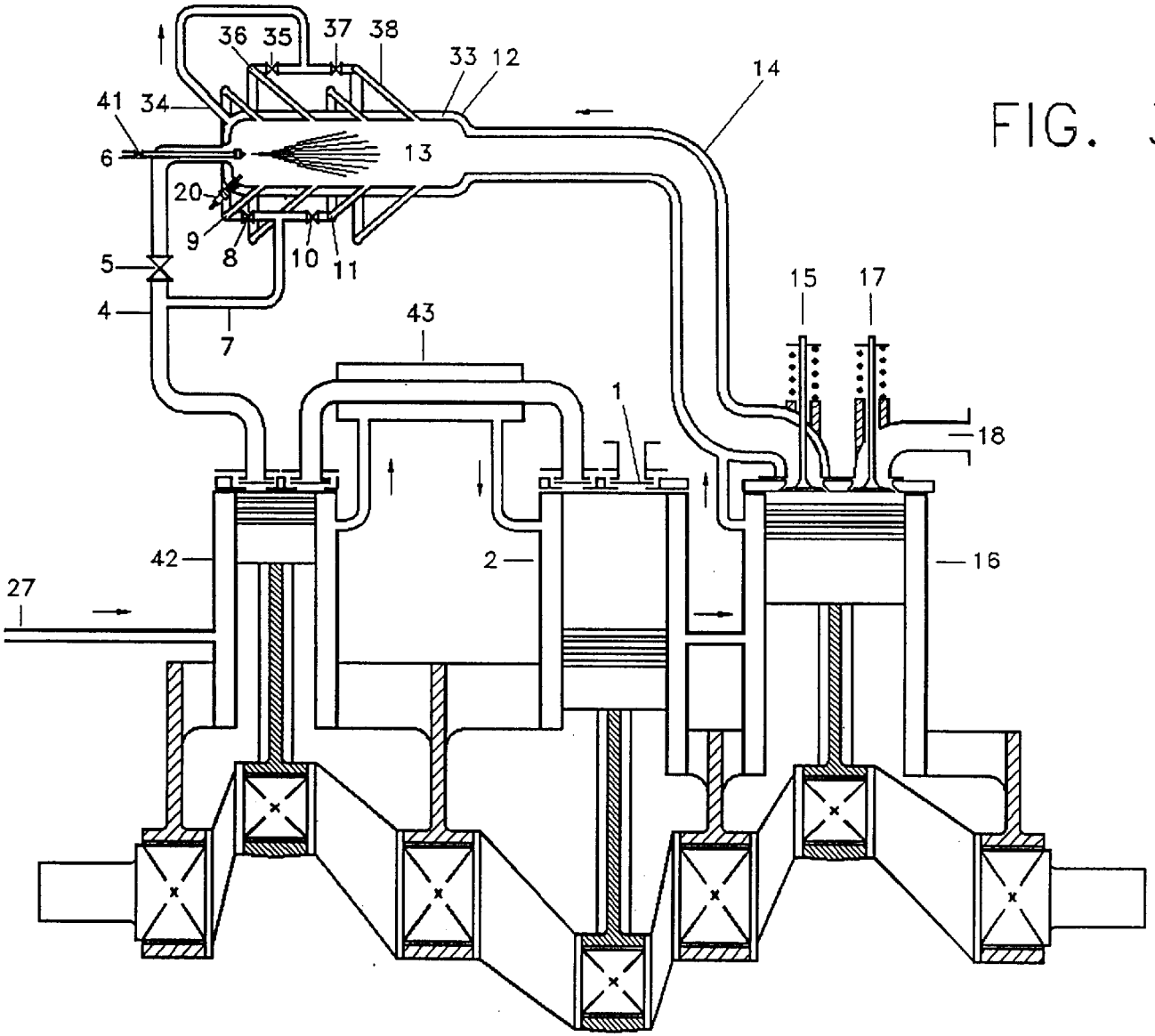
FIG. 3 shows the same principle of the engine, but equipped with a two stage compressor and an air cooler located between the two stages.

FIG. 3 shows an engine with the same operating principle of the engine shown in FIG. 1, but comprising a compressor of two stages, and with an air cooler between the two stages that reduces the energy required for the air compression. The second stage is indicated by 42, and the air cooler is indicated by 43. The arrows illustrate again the path of the water.

Since only a part of the heat transmitted to the cooling water is recuperated in the power mechanism, the gain in efficiency of this cycle is obtained not because the heat transmitted to the cooling water in the combustor is recuperated, but because the heat transmitted to the cooling water in the jackets of the power cylinder and the compressor is recuperated. It is therefore convenient to reduce the heat transmitted through the internal wall of the combustor. To accomplish this, and also to avoid that the temperature of cooling water-steam rises excessively, the inner surface of the internal wall of the combustor and the internal surface of the duct interconnecting the combustor with the power mechanism are insulated with an insulating-refractory material 40 as shown in FIG. 2.

The admission valve 15 to the engine is exposed to a very high temperature, therefore, it is necessary to cool it by means of circulating water, or by means of metallic sodium introduced and sealed in the interior of the stem of the valve. This last practice is well known and used in high specific output internal combustion engines.

Figure 4:
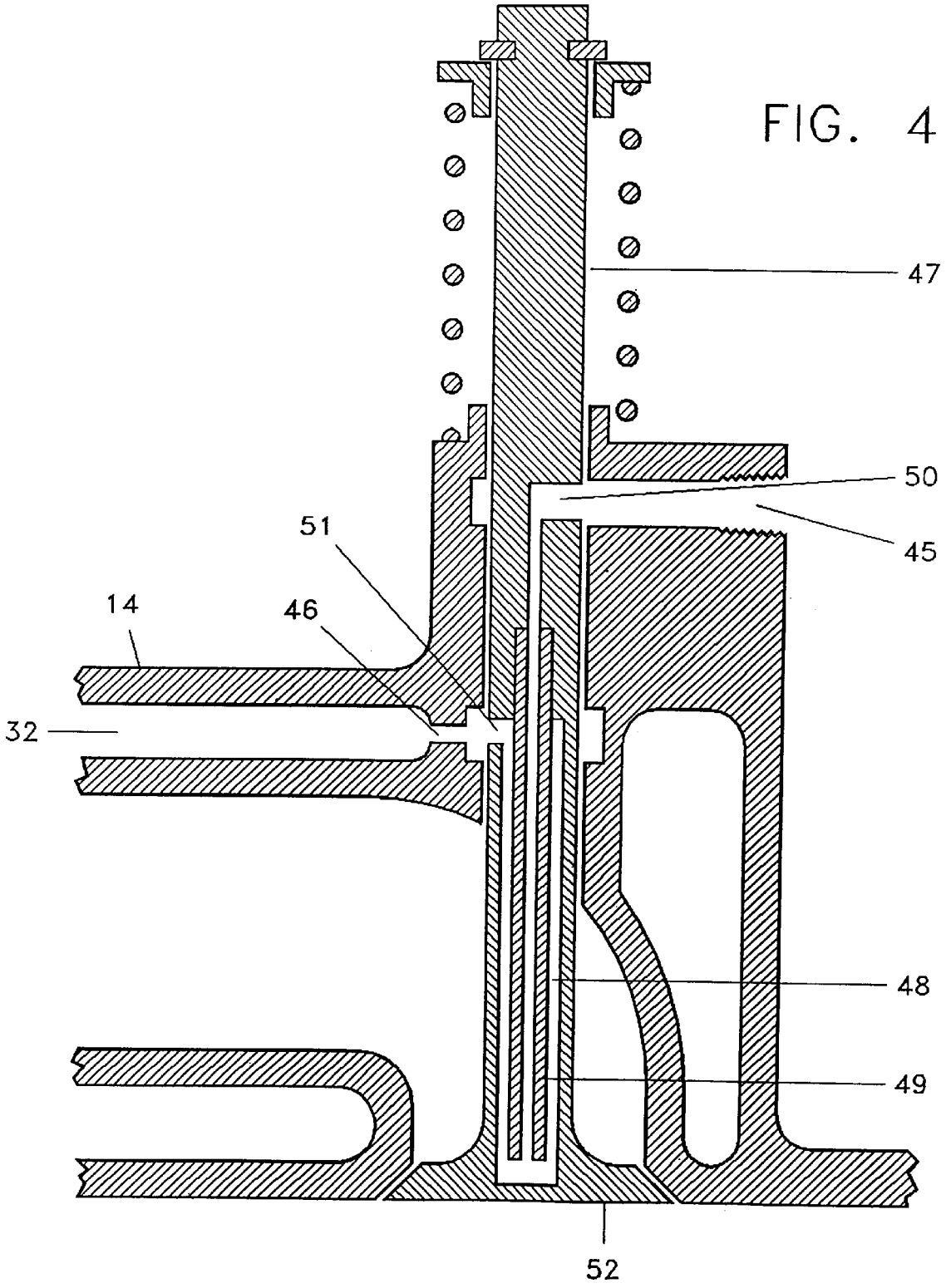
FIG. 4 shows a water cooled admission valve
Figure 5:
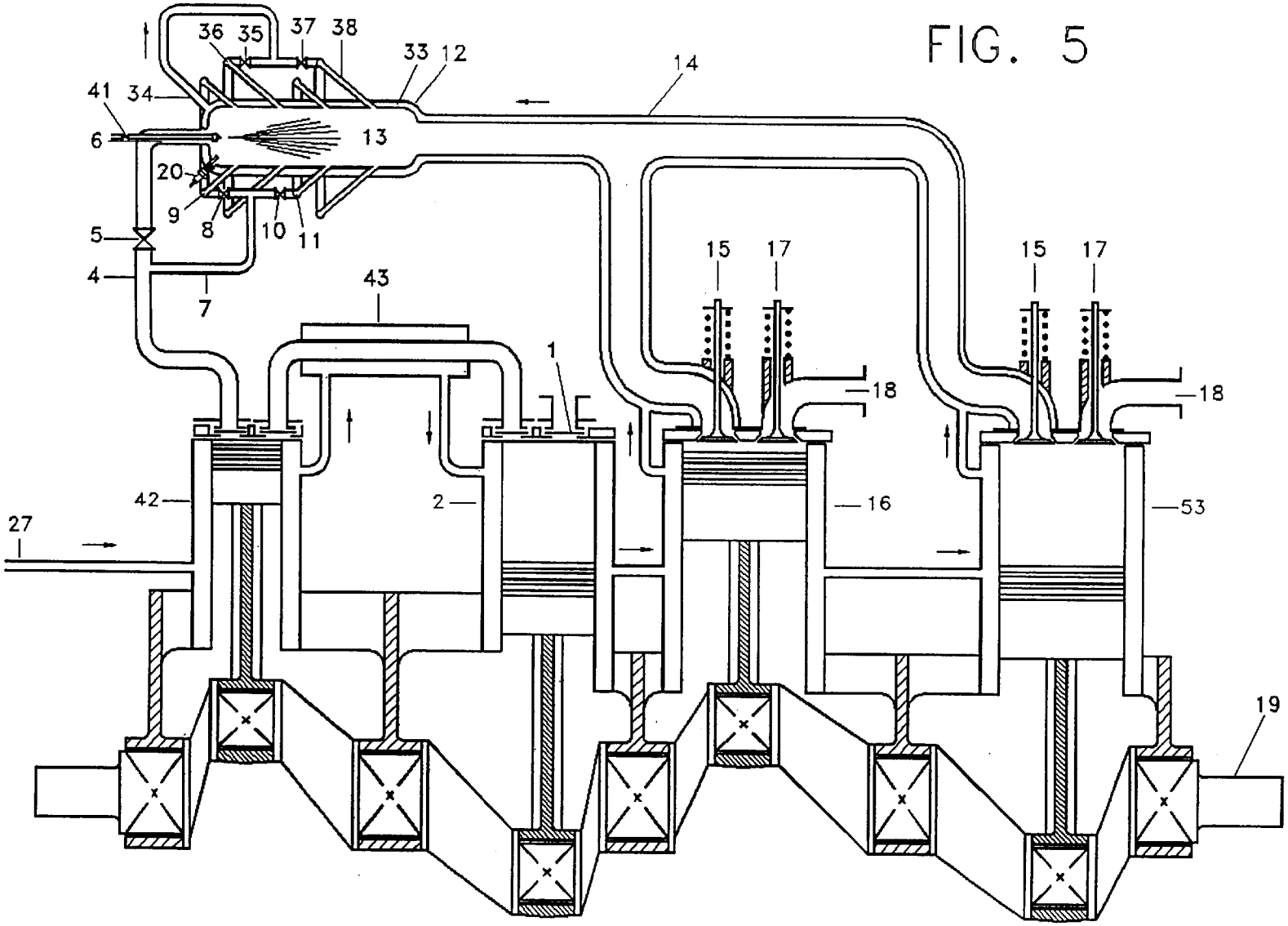
FIG. 5, shows a sectional view of the engine equipped with a two stage compressor, and an air cooler located between the two stages and a power mechanism comprised by two cylinders.

FIG. 4 shows a water cooled valve of the type operated by a cam and rocker arm; these last two parts are not shown. The lower part of the stem 47 of the valve is hollow, and inside the hole 48 there is a small diameter tube 49. The cooling water enters through the water entrance 45 and the opening in the stem 50 to the hole in the stem, the water cools the stem of the valve all the way dawn to the head of the valve 52 and returns to the middle part of the stem through the space between the tube 49 and the hole 48 and exits through the opening 51 in the stem and outlet opening 46 to the jacket 32 of the duct 14 interconnecting the combustor with the power mechanism.

The system of this engine is very flexible; the compression factor, the excess air, the amount of heat transmitted to the cooling water, the amount of heat recuperated by the injection water, the expansion factor, can all be varied in order to obtain the most adequate arrangement for a particular application. A vehicular engine, by example, must be light, and admits certain efficiency sacrifice, while an stationary engine should be more robust and more efficient.

After describing the invention, it will be clear that the main advantages of the engine of the present invention are:

Substantial reduction of all the contaminants.

Higher efficiency.

Ability to burn less refined and less expensive fuels that do not require antidetonants.

The manufacturing technology is the same as the technology of the internal combustion engines.

The expansion and compression ratios are totally independent, which gives great flexibility to the cycle.

What I claim is the following:

1. An external combustion engine characterized by the emission of low level of contaminants, and accomplishing this with increased efficiency; said engine comprises:

a) a compressor of the reciprocating type with at least one cylinder; said compressor supplies the air required for the combustion of the fuel at sufficiently high pressure to introduce it into a combustion chamber; said compressor is equipped with water cooled jackets;

b) a power mechanism of the reciprocating type comprising at least one cylinder; this power mechanism is the element that converts the heat energy liberated in the combustion chamber to the mechanical energy that besides driving the compressor, a water pump and other usual mechanisms of the engine, becomes available for external use in the crankshaft; said power mechanism is equipped with water cooler jackets;

c) the combustion chamber comprised by one vessel designed to withstand the operating pressure; the plenum of said combustion chamber is provided with fuel, air, and water or steam entrances at various locations, and means for controlling the flow of air and water in each of these entrances in order to accomplish an efficient and complete combustion with a minimum generation of contaminants; said combustion chamber is equipped with water cooled jackets;

d) a duct interconnecting said compressor with said combustion chamber to convey the compressed air from said compressor to said combustion chamber;

e) a duct interconnecting said combustion chamber with said power mechanism to convey the combustion gases and the steam generated by the injected water to the power mechanism; the walls of the this duct are equipped with water cooled jackets;

f) means of pressurizing cooling water and forcing its circulation throughout the water cooled jackets of the compressor, the power mechanism, the combustor and the duct interconnecting the combustor and the power mechanism and injecting said water into the combustor in order to recuperate the heat transmitted to the cooling water; this means comprises the water pump, all the jackets, and the conduits and openings through which the water is injected.

2. An external combustion engine according to claim 1, wherein the compressor has more than one stage of compression with air intercoolers located between the stages.

3. An external combustion engine according to claim 1, wherein the reciprocating type compressor has several cylinders.

4. An external combustion engine according to claim 1, wherein the reciprocating type engine has several cylinders.

5. An external combustion engine according to claim 1, wherein the inner surf ace of the internal wall of the combustion chamber and the internal wall of the duct interconnecting the combustion chamber with the power mechanism are insulated with an insulating refractory material.

6. An external combustion engine according to claim 1, wherein the admission valves of the power mechanism are water cooled.

7. An external combustion engine according to claim 2, wherein the inner surface of the internal wall of the combustion chamber and the internal wall of the duct interconnecting the combustion chamber with the power mechanism are insulated with an insulating refractory material.

8. An external combustion engine according to claim 3, wherein the inner surface of the internal wall of the combustion chamber and the internal wall of the duct interconnecting the combustion chamber with the power mechanism are insulated with an insulating refractory material.

9. An external combustion engine according to claim 4, wherein the inner surface of the internal wall of the combustion chamber and the internal wall of the duct interconnecting the combustion chamber with the power mechanism are insulated with an insulating refractory material.

10. An external combustion engine according to claim 2, wherein the admission valves of the power mechanism are water cooled.

11. An external combustion engine according to claim 3, wherein the admission valves of the power mechanism are water cooled.

12. An external combustion engine according to claim 4, wherein the admission valves of the power mechanism are water cooled.

13. An external combustion engine according to claim 5, wherein the admission valves of the power mechanism are water cooled.

14. An external combustion engine according to claim 7, wherein the admission valves of the power mechanism are water cooled.

15. An external combustion engine according to claim 8, wherein the admission valves of the power mechanism are water cooled.

16. An external combustion engine according to claim 9, wherein the admission valves of the power mechanism are water cooled.

* * * * *